US006397835B1

(12) United States Patent
Liang

(10) Patent No.: US 6,397,835 B1
(45) Date of Patent: Jun. 4, 2002

(54) PORTABLE GAS BURNER

(76) Inventor: Hsin-Lien Liang, No. 80, Tzu Chung 2nd Street, Chung-Li City, Tao-Yuan Hsien (TW)

( * ) Notice: Subject to any disclaimer, the term of this patent is extended or adjusted under 35 U.S.C. 154(b) by 0 days.

(21) Appl. No.: 09/962,227

(22) Filed: Sep. 26, 2001

(51) Int. Cl.[7] ..... F21L 19/00; F24C 5/20; F24C 3/04; F24B 3/00

(52) U.S. Cl. ..... 126/92 B; 431/153; 431/255; 431/344; 431/343; 362/178; 362/415

(58) Field of Search ..... 431/154, 153, 431/344, 343, 345, 255; 126/92 B, 92 R, 41 R, 39 R; 362/415, 17 B

(56) References Cited

U.S. PATENT DOCUMENTS 1,042,750 A * 10/1912 Bader
4,321,656 A * 3/1982 Gruver, Jr.
4,445,495 A * 5/1984 Frost
4,569,329 A * 2/1986 Cherryholmes
5,890,887 A * 4/1999 Adler
6,033,212 A * 3/2000 Bonnema et al.
6,253,760 B1 * 7/2001 Mashburn et al.

* cited by examiner

*Primary Examiner*—Carl D. Price
(74) *Attorney, Agent, or Firm*—Rosenberg, Klein & Lee

(57) ABSTRACT

A portable gas burner having a swivel bracket mounted inside the housing thereof to hold a gas pressure regulator adapted to receive a gas can, and a tilting switch fixedly mounted on the swivel bracket adapted to control on/off of a gas switch that controls the supply of fuel gas from the loaded gas can to the burner grate of the burner unit of the portable gas burner. The tilting switch switches off the gas switch to stop the supply of fuel gas to the burner unit when the loaded gas can not kept in vertical.

1 Claim, 5 Drawing Sheets

PORTABLE GAS BURNER

BACKGROUND OF THE INVENTION

The present invention relates to gas burners and, more specifically, to a portable gas burner, which automatically cuts off fuel gas supply when the gas can not kept in vertical.

FIG. 1 shows standing gas burner according to the prior art. The standing gas burner has a height H about 200 cms. The standing gas burner has a gas tank holder shell 1 that can be moved up and down between the open position and the close position during installation of a gas tank 2. This structure of standing gas runner occupies much vertical space, not suitable for use on a table. In order to eliminate this problem, mini portable gas burners are developed. Regular portable gas burners use a gas can to provide fuel gas. However, a commercially available gas can does not have the gas pressure regulator 21 of a gas tank 2 (see FIG. 1). Further, when a portable gas burner falls down, or the gas can is tilted during operation, fuel gas leaks out of the gas can continuously.

SUMMARY OF THE INVENTION

The present invention has been accomplished to provide a portable gas burner, which eliminates the aforesaid drawbacks. It is one object of the present invention to provide a portable gas burner, which is safety in use. It is another object of the present invention to provide a portable gas burner, which facilitates the installation of a gas can. To achieve these and other objects of the present invention, the portable gas burner comprises a housing and a burner unit supported on an upright support at the top side of the housing, a swivel bracket mounted inside the housing to hold a gas pressure regulator adapted to receive a gas can, and a tilting switch fixedly mounted on the swivel bracket adapted to control on/off of the gas switch that controls the supply of fuel gas from the loaded gas can to the burner grate of the burner unit. The tilting switch switches off the gas switch to stop the supply of fuel gas to the burner unit when the loaded gas can not kept in vertical.

DETAILED DESCRIPTION OF THE PREFERRED EMBODIMENT

Figure 1:
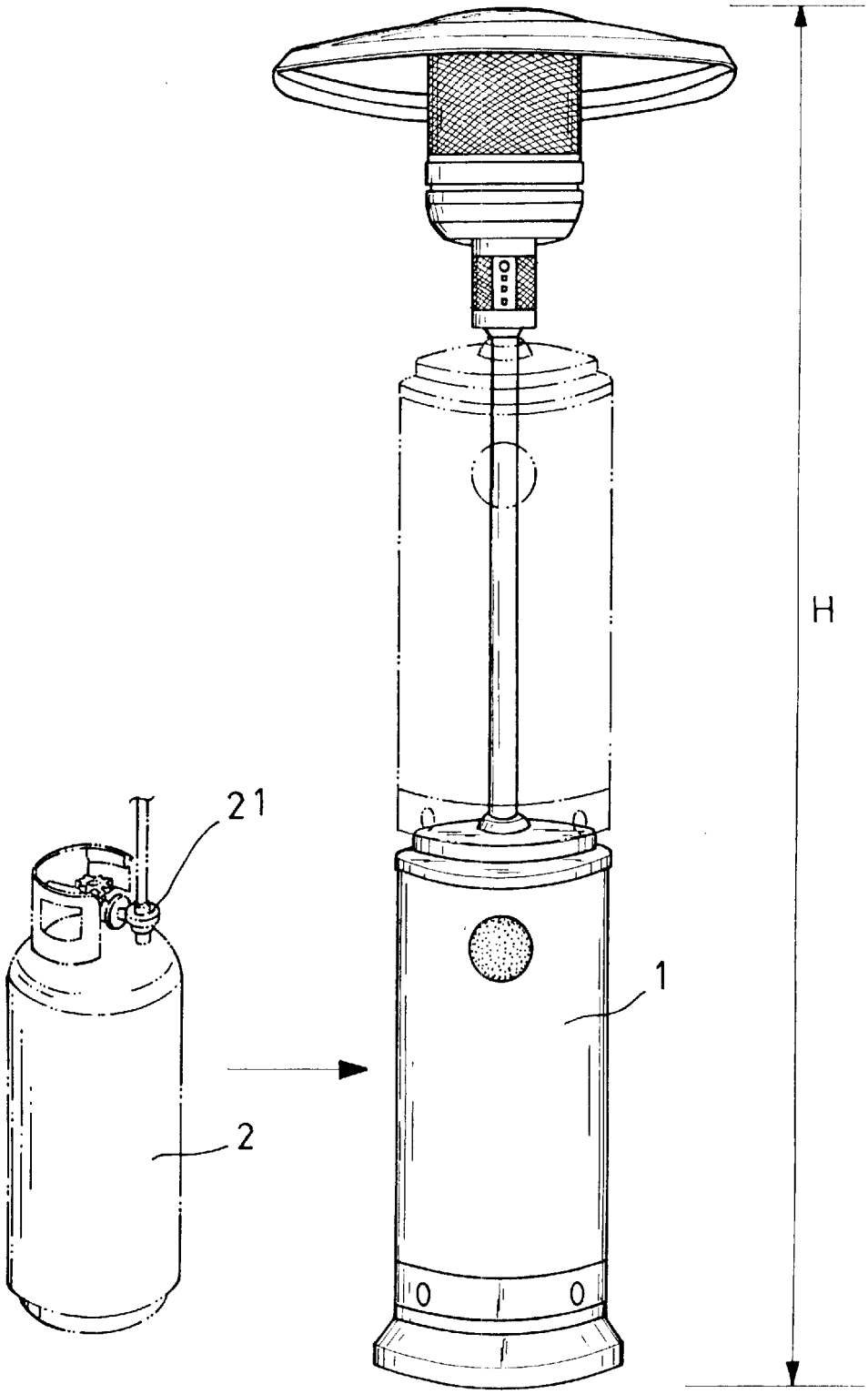
FIG. 1 PRIOR ART
FIG. 1 illustrates a standing gas burner according to the prior art.
Figure 2:
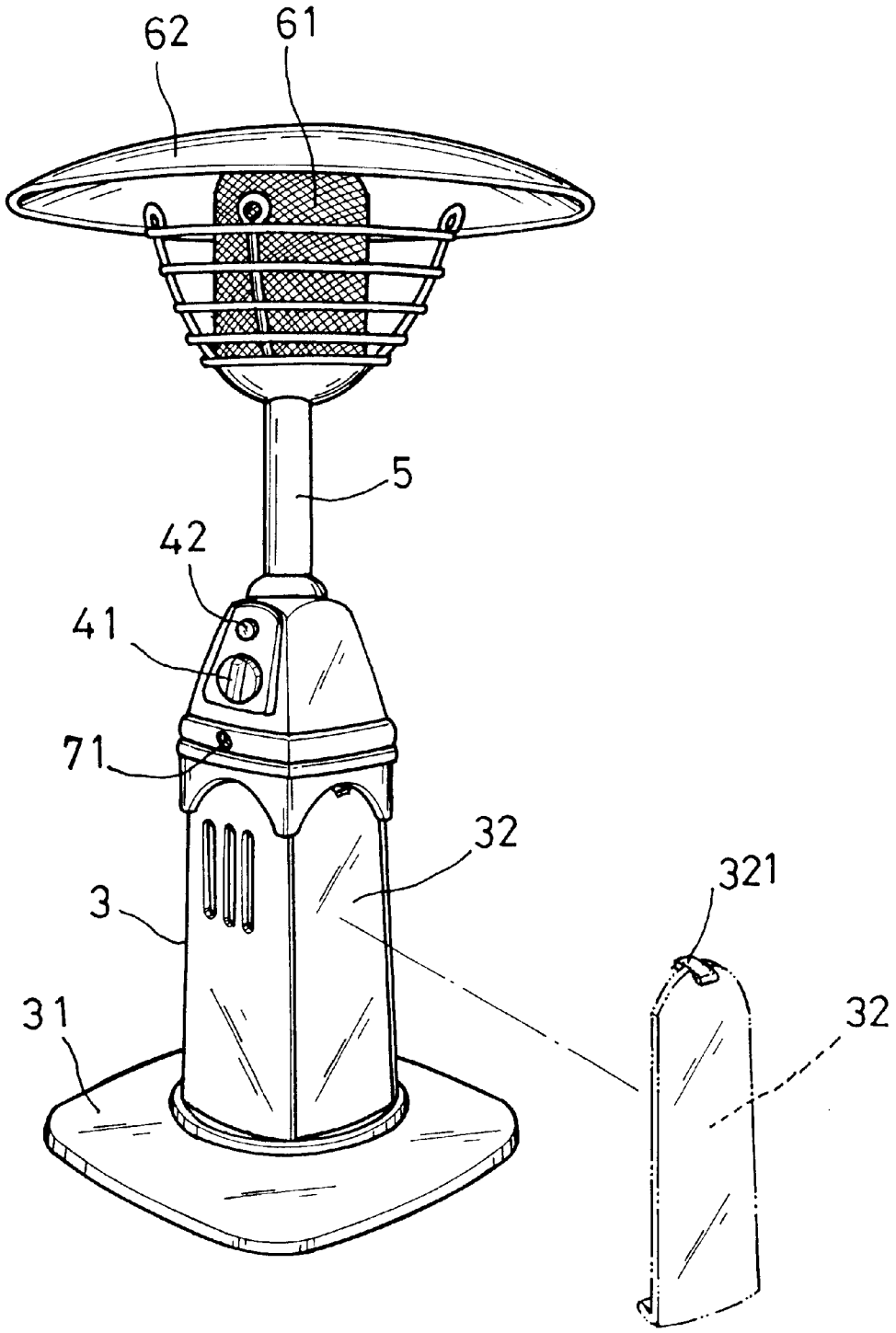
FIG. 2 is an elevational view of a portable gas burner according to the present invention (the door not fastened to the housing).
Figure 3:
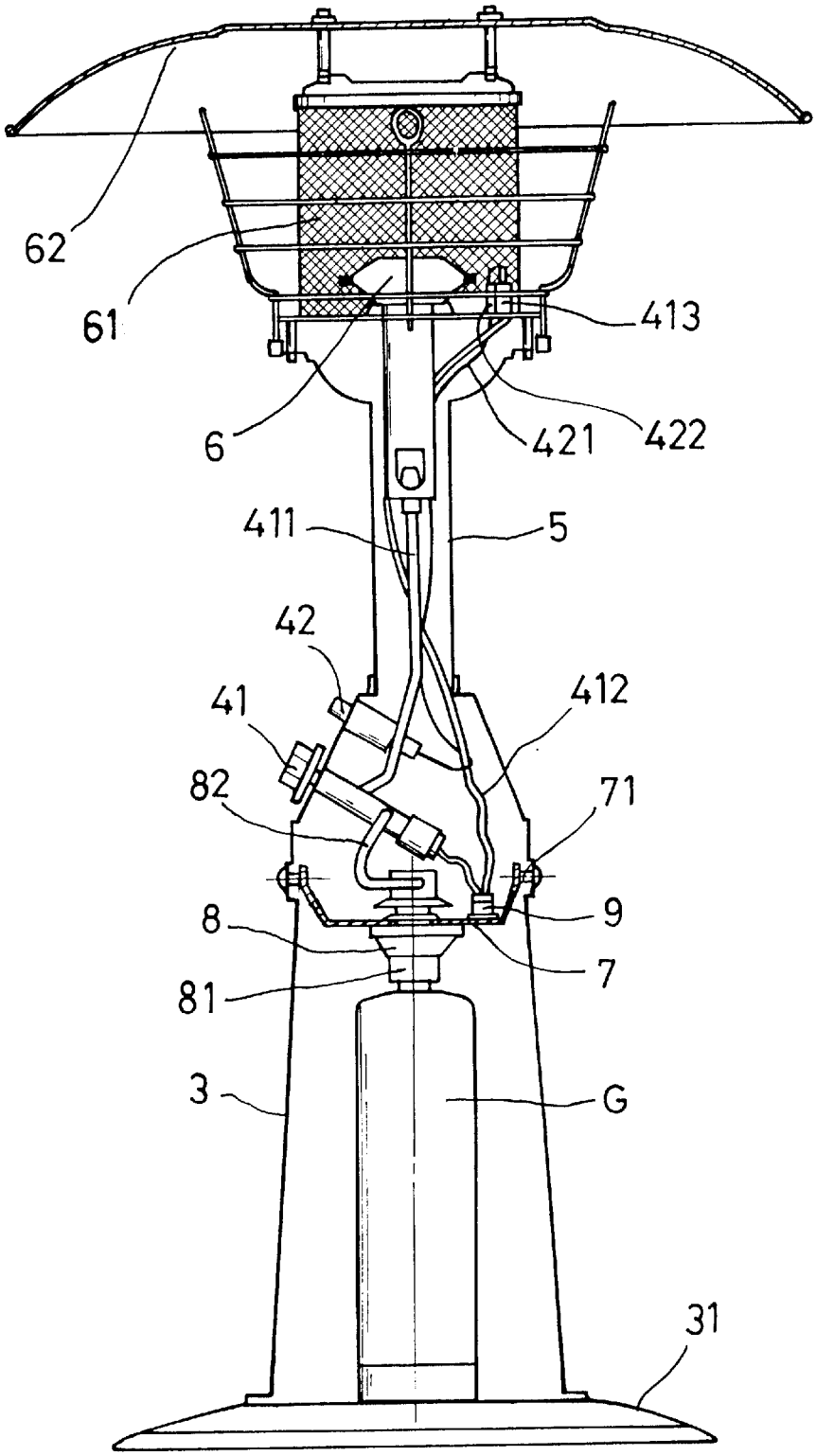
FIG. 3 is a sectional view of the present invention showing a gas can installed in the housing and connected to the gas pressure regulator.

Referring to FIGS. 2 and 3, a portable gas burner is shown comprising:

- a housing 3 adapted to hold a gas can G, the housing 3 comprises a flat, extended base 31 adapted to support the portable gas burner stably on a flat surface, for example, the top of a table, a gas switch 41 and an ignition switch 42;
- a tubular upright support 5 upwardly extended from the topside of the housing 3;

- a burner unit 6 supported on the top side of the upright support 5 and adapted to receive fuel gas from a gas can G, the burner unit 6 comprising a metal fire net 61 around the burner grate thereof, and a reflector 62 suspended above the metal fire net 61;
- a main gas tube 411 extended from the gas switch 41 through the tubular upright support 5 to the burner grate of the burner unit 6;
- an electronic igniter 422 and a thermocouple 413 respectively disposed adjacent to the burner unit 6;
- a high-voltage wire 421 extended from the ignition switch 42 through the tubular upright support 5 to the igniter 422; and
- a thermocouple wire 412 extended from the gas switch 412 through the tubular upright support 5 to the thermocouple 413.

The main features of the present invention are outlined hereinafter. Pivots 71 are fastened to the housing 3 to secure a substantially U-shaped swivel bracket 7 inside the housing 3. The swivel bracket 7 holds a gas pressure regulator 8, having a fuel gas input connector 81 disposed at the bottom side and adapted to receive the gas output nozzle of a gas can G, and a gas output tube 82 connected to the main gas tube 411 through the gas switch 41. A tilting switch 9 is fixed mounted on the swivel bracket 7 and electrically connected between the thermocouple wire 412 and the solenoid valve of the gas switch 41. When tilting the swivel bracket 7, the tilting switch 9 is switched off. The housing 3 has an access hole 32 at one side, and a detachable door 32 adapted to close the access hole 32. When opened the door 32, a gas can G can be moved in and out of the housing 3. The tilting switch 9 is similar to a regular vibration switch having mercury contact means that switches off the circuit when tilted. When switched off, the tilting switch 9 stops the fuel gas passage between the gas switch 41 and the gas tube 411.

The thermocouple 413 produces a potential difference and then outputs an electric current to the gas switch 41 when heated, thereby causing the solenoid valve of the gas switch 41 to open the valve port and to let fuel gas pass from the gas pressure regulator 8 to the main gas tube 411 and then the burner grate of the burner unit 6. On the contrary, when the flame extinguished or the gas burner fell down, the thermocouple 413 is off, and the solenoid valve of the gas switch 41 is returned to the off position to close the valve port and to stop the supply of fuel gas.

Referring to FIG. 2 again, the detachable door 32 has a hook 321 that can be hooked in a part, for example, a hole in the housing 3 to secure the door 32 to the housing 3.

Figure 4:
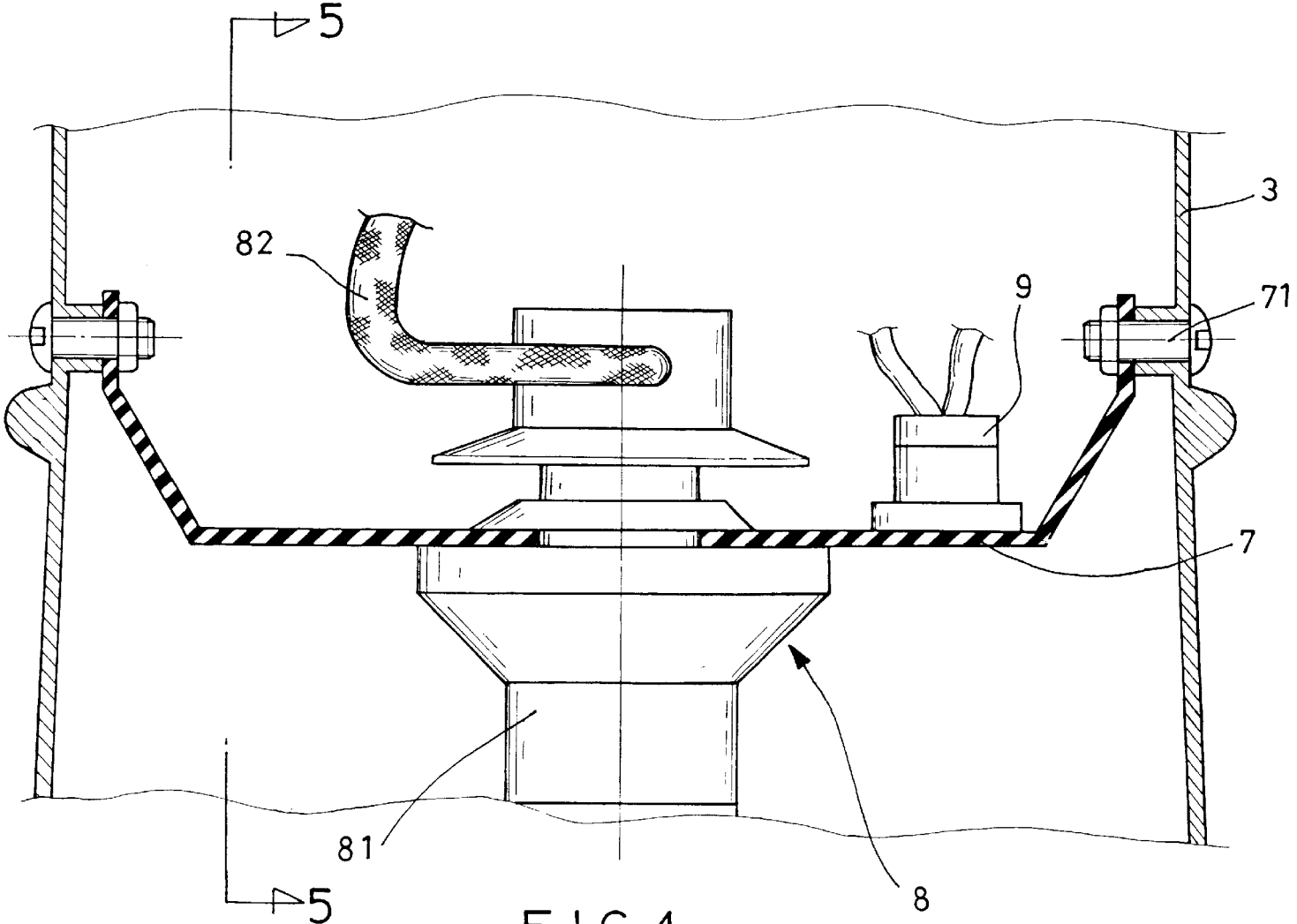
FIG. 4 is a sectional view in an enlarged scale of a part of the present invention.
Figure 5:
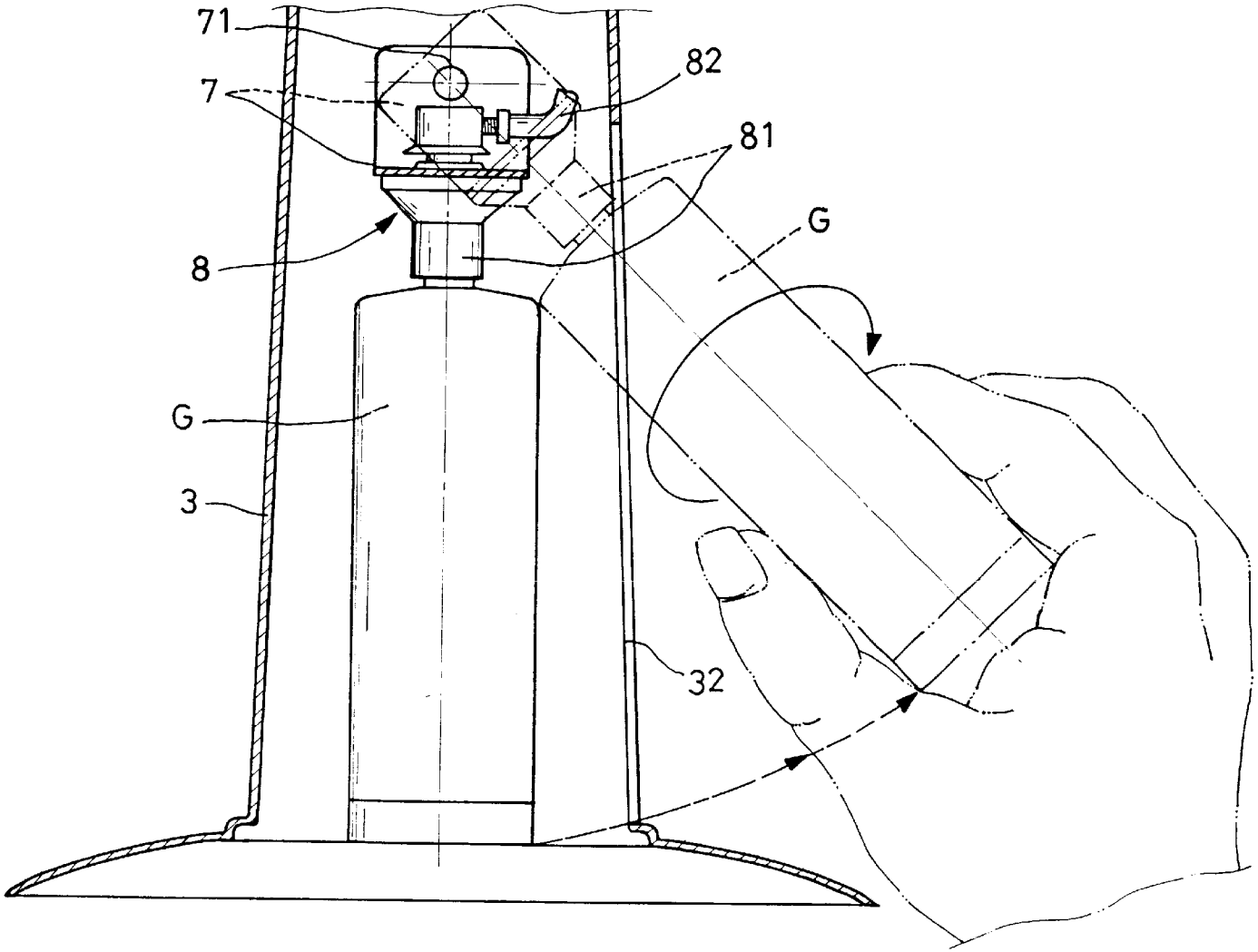
FIG. 5 is a schematic drawing showing the installation of a gas can.

Referring to FIGS. 4 and 5, when installing a gas can G, the swivel arm 7 is turned to a 45° tilting angle, and then the gas can G is fastened to the fuel gas input connector 81 of the gas pressure regulator 8, and then the gas can G is put inside the housing 3 and set in vertical. When keeping the gas can G (or the housing 3) in vertical, the tilting switch 9 is switched on. On the contrary, when tilting the gas can G (or the housing 3), the tilting switch 9 is switched off. Therefore, the present invention is safe in use. If the loaded gas can G is not kept in vertical, no fuel gas supply is provided to the main gas tube 411 and the gas burner unit 6.

A prototype of portable gas burner has been constructed with the features of the annexed drawings of FIGS. 2~5. The portable gas burner functions smoothly to provide all of the features discussed earlier.

Although a particular embodiment of the invention has been described in detail for purposes of illustration, various modifications and enhancements may be made without departing from the spirit and scope of the invention.

Accordingly, the invention is not to be limited except as by the appended claims.

What the invention claimed is:

1. A portable gas burner comprising:

a housing adapted to hold a gas can, said housing comprising a flat, extended base adapted to support the portable gas burner on a flat surface, a solenoid valve-controlled gas switch adapted to control output of fuel gas from the gas can being installed in said housing, and an ignition switch adapted to control the operation of an electronic igniter;

a tubular upright support upwardly extended from a top side of said housing;

a burner unit supported on said upright support and adapted to receive fuel gas from a gas can, said burner unit comprising a metal fire net around a burner grate thereof, and a downward reflector suspended above said metal fire net;

a main gas tube extended from said gas switch through said tubular upright support to the burner grate of said burner unit;

an electric igniter and a thermocouple respectively disposed adjacent to said burner unit;

a high-voltage wire extended from said ignition switch through said tubular upright support to said igniter; and a thermocouple wire extended from said gas switch through said tubular upright support to said thermocouple;

wherein said housing comprises a substantially U-shaped swivel bracket pivoted thereto on the inside, a gas pressure regulator fixedly mounted on said swivel bracket, said gas pressure regulator having a fuel gas input connector disposed at a bottom side and adapted to receive the gas output nozzle of a gas can and a gas output tube connected to said main gas tube through said gas switch, and a tilting switch fixed mounted on said swivel bracket and electrically connected between said thermocouple wire and the solenoid valve of said gas switch.

* * * * *